US010006169B2

(12) United States Patent
Dietz et al.

(10) Patent No.: US 10,006,169 B2
(45) Date of Patent: Jun. 26, 2018

(54) METHOD FOR DELIGNIFYING AND BLEACHING PULP

(71) Applicant: Evonik Degussa GmbH, Essen (DE)

(72) Inventors: Thomas Dietz, Haibach (DE); Bernd Hopf, Kahl (DE); Ralf Grimmer, Freigericht (DE); Sigrid Wegmann, Freigericht (DE); Verena Illhardt, Schimborn (DE)

(73) Assignee: Evonik Degussa GmbH, Essen (DE)

( * ) Notice: Subject to any disclaimer, the term of this patent is extended or adjusted under 35 U.S.C. 154(b) by 91 days.

(21) Appl. No.: 15/034,453

(22) PCT Filed: Oct. 15, 2014

(86) PCT No.: PCT/EP2014/072096
§ 371 (c)(1),
(2) Date: May 4, 2016

(87) PCT Pub. No.: WO2015/067446
PCT Pub. Date: May 14, 2015

(65) Prior Publication Data

US 2016/0298294 A1 Oct. 13, 2016

(30) Foreign Application Priority Data

Nov. 6, 2013 (DE) ..... 10 2013 222 468

(51) Int. Cl.

| | |
|---|---|
| ***D21C 9/16*** | (2006.01) |
| ***D21C 9/10*** | (2006.01) |
| ***D21C 9/147*** | (2006.01) |
| ***D21C 9/02*** | (2006.01) |
| ***D21C 3/00*** | (2006.01) |
| ***D21C 3/02*** | (2006.01) |

(52) U.S. Cl.
CPC ..... *D21C 9/163* (2013.01); *D21C 3/00* (2013.01); *D21C 3/026* (2013.01); *D21C 9/10* (2013.01); *D21C 9/1036* (2013.01); *D21C 9/1042* (2013.01); *D21C 9/1057* (2013.01); *D21C 9/147* (2013.01); *D21C 9/16* (2013.01); *D21C 9/166* (2013.01)

(58) Field of Classification Search
CPC ..... D21C 9/163; D21C 9/16; D21C 9/1036; D21C 3/00; D21C 3/026; D21C 9/10; D21C 9/1042; D21C 9/1057; D21C 9/147
See application file for complete search history.

(56) References Cited

U.S. PATENT DOCUMENTS

| | | | | |
|---|---|---|---|---|
| 3,835,001 | A | 9/1974 | O'Brien | |
| 4,065,475 | A | 12/1977 | Hosoi et al. | |
| 4,401,631 | A | 8/1983 | Canavesi et al. | |
| 4,427,490 | A * | 1/1984 | Eckert | D21C 9/1036 162/78 |
| 4,661,205 | A * | 4/1987 | Ow | D21C 9/163 162/78 |
| 5,114,611 | A * | 5/1992 | Van Kralingen | C11D 3/3932 252/186.26 |
| 5,667,694 | A | 9/1997 | Cody et al. | |
| 5,904,734 | A * | 5/1999 | Friberg | C11D 3/3932 252/186.33 |
| 6,048,437 | A | 4/2000 | Fukushima et al. | |
| 6,165,318 | A * | 12/2000 | Paren | D21C 9/1036 162/76 |
| 6,432,266 | B1 | 8/2002 | Fukushima et al. | |
| 6,660,128 | B1 | 12/2003 | Bourbonnais et al. | |
| 7,250,106 | B2 | 7/2007 | Benazzi et al. | |
| 8,277,765 | B2 * | 10/2012 | Dietz | B01D 15/00 423/54 |
| 8,545,673 | B2 * | 10/2013 | Dietz | B01D 15/00 162/40 |
| 8,568,558 | B2 * | 10/2013 | Dietz | D21C 9/1036 162/78 |
| 9,683,329 | B2 * | 6/2017 | Amidon | D21C 3/04 |
| 2001/0025695 | A1 | 10/2001 | Patt et al. | |
| 2003/0019596 | A1 | 1/2003 | Ragauskas et al. | |
| 2007/0079944 | A1 | 4/2007 | Amidon et al. | |
| 2009/0274598 | A1 * | 11/2009 | Dietz | B01D 15/00 423/54 |
| 2011/0174451 | A1 * | 7/2011 | Dietz | D21C 9/1036 162/67 |
| 2012/0305208 | A1 * | 12/2012 | Dietz | B01D 15/00 162/40 |
| 2015/0007951 | A1 * | 1/2015 | Dietz | B01J 20/10 162/45 |
| 2016/0298294 | A1 * | 10/2016 | Dietz | D21C 3/00 |
| 2017/0159237 | A1 * | 6/2017 | Buschmann | C02F 9/00 |
| 2017/0306557 | A1 * | 10/2017 | Amidon | D21C 5/005 |

FOREIGN PATENT DOCUMENTS

| | | |
|---|---|---|
| CA | 1 129 161 | 8/1982 |
| CN | 101792851 | 8/2010 |

(Continued)

OTHER PUBLICATIONS

Bandeira et al., in "ECF Bleaching with Molybdenum Activated Acid Peroxide and Its Impact on Eucalyptus Pulp Properties and Effluent Quality," Natural Resources 2, pp. 61-70 (Year: 2011).*

(Continued)

*Primary Examiner* — Jose A Fortuna

(74) *Attorney, Agent, or Firm* — Law Office of Michael A. Sanzo, LLC

(57) ABSTRACT

Process for the delignification and bleaching of pulp, comprising a first bleaching stage with hydrogen peroxide in the presence of a molybdate or tungstate in an acidic aqueous mixture; subsequent to the first bleaching stage, a second bleaching stage with hydrogen peroxide in an alkaline aqueous mixture; and, subsequent to the second bleaching stage, a third bleaching stage with hydrogen peroxide in the presence of a molybdate or tungstate in an acidic aqueous mixture.

18 Claims, No Drawings

(56) References Cited

FOREIGN PATENT DOCUMENTS

| | | | | |
|---|---|---|---|---|
| CZ | 279 703 | | 6/1995 | |
| DE | 44 46 122 | A1 | 6/1996 | |
| DE | 10 2008 040 884 | | 2/2010 | |
| EP | 0 765 842 | A1 | 4/1997 | |
| FR | 2 320 946 | | 3/1977 | |
| FR | 2969668 | A1 * | 6/2012 | ..... D21C 3/003 |
| GB | 2 065 628 | A | 7/1981 | |
| JP | 61-261215 | | 11/1986 | |
| JP | 6-10089 | | 1/1994 | |
| JP | 11-130762 | | 5/1999 | |
| JP | 2003-48716 | | 2/2003 | |
| RU | 1836465 | A3 | 8/1993 | |
| RU | 2 176 677 | C2 | 12/2001 | |
| WO | WO 95/35406 | | 12/1995 | |
| WO | WO 96/01921 | | 1/1996 | |
| WO | WO 96/37654 | | 11/1996 | |
| WO | WO 2009/108111 | | 9/2009 | |
| WO | WO 2009/133053 | | 11/2009 | |

OTHER PUBLICATIONS

International Search Report for PCT/EP2014/072096 filed Oct. 15, 2014.

English language translation of the Written Opinion of the International Searching Authority PCT/EP EP2014/072096 filed Oct. 15, 2014.

International Preliminary Report on Patentability for PCT/ EP2014/072096 filed Oct. 15, 2014.

Search Report for corresponding German application 10 2013 222 468 dated Jun. 11, 2013 with English language machine translation attached.

Atia, "Adsorption of chromate and molybdate by cetylpyridinium bentonite," *Applied Clay Science 41*:73-84 (2008) (available online Oct. 2007).

Database WPI Week 200165; Thomson Scientific, London, GB; AN 2001-577936; XP002540018 (Aug. 2001).

Green, et al., Perry's Chemical Engineers' Handbook, Eighth Edition; chapters 18.9 and 20.3.3; McGraw-Hill Education, published as an ebook Nov. 2007.

Kubelka, et al.,"Delignification with Acidic Hydrogen Peroxide Activated by Molybdate," *Journal of Pulp Paper and Science 18*(3):J108-J114 (May 1992).

Manning, et al., "Addition of Hydrogen Peroxide and Molybdate to Chlorine Dioxide Bleaching Stages," *Journal of Pulp Paper and Science32*(2):58-62 (Apr./May/Jun. 2006).

Milagres, et al., "Bleaching eucalyptus pulps with short sequences," *Proceedings 3rd ICEP—International Colloqiuin on Eucalyptus Pulp*, pp. 1-5 (Mar. 2007) with English language translation attached.

Sameer, et al., "Recovery of Catalytic Molybdate from Dilute Solutions," In the proceedings of the 93rd annual conference of the PATPTAC, pp. A261-A268 (Apr. 2007).

Sameer, et al., "Recovery of Molybdate from Dilute Aqueous Solutions by Complexation with Cationic Surfactants and Extraction with Isobutanol," *Ind. Eng. Chem. Res. 47*:428-433 (2008), (published online Dec. 2007).

Packham, et al., "Water Clarification by Flotation-1," The Water Research Association, Technical Paper TP 8.7, Nov. 1972.

* cited by examiner

METHOD FOR DELIGNIFYING AND BLEACHING PULP

CROSS REFERENCE TO RELATED APPLICATIONS

The present application is US national stage of international application PCT/EP2014/072096, which had an international filing date of Oct. 15, 2014, and which was published in German on May 14, 2015. Priority is claimed to German application DE 10 2013 222 468.0, filed on Nov. 6, 2013. The contents of the priority application is hereby incorporated by reference in its entirety.

The invention relates to a process for the delignification and bleaching of pulp with no need for any oxidizing agents other than oxygen and hydrogen peroxide.

For the manufacture of paper, following pulp cooking, the pulp has to be delignified and bleached in a plurality of stages. Whereas, in the past, elemental chlorine was mainly used for the delignifying and bleaching, it is nowadays preferred in ECF (Elemental Chlorine-Free) bleaching to employ bleaching sequences which use chlorine dioxide instead of elemental chlorine. The bleaching sequence most frequently employed in this case is $ODE_{OP}DP$, where O stands for a delignification with oxygen under alkaline conditions, D denotes stages with chlorine dioxide as delignifying and bleaching agent, $E_{OP}$ stands for an alkaline extraction with addition of oxygen and hydrogen peroxide, P denotes a bleaching stage with hydrogen peroxide in the alkaline range, with the pulp being washed between each of the individual stages. The nomenclature rules of the "Glossary of Bleaching Terms" by the Bleaching Committee, Technical Section, Canadian Pulp and Paper Association (ISBN 1-895288-90-8) are used here and hereinafter for the coding of bleaching stages and bleaching sequences by means of letters.

A disadvantage of chlorine dioxide is that it cannot be transported or stored for a long time, and so, for the bleaching of pulp, it must be manufactured in a separate unit at the pulp mill. Consequently, in addition to the costs for the sodium chlorate starting material, there are also capital costs and operating costs incurred for such a unit. Moreover, even in the case of delignification with chlorine dioxide, chlorinated compounds are formed, and lead to the undesirable presence of organochlorine substances in the pulp and in the wastewater.

To avoid these disadvantages of chlorine dioxide, the oxidizing agents ozone and percarboxylic acids, such as peracetic acid and monoperoxysulphuric acid, have been used as alternative delignifying agents. These oxidizing agents allow bleaching sequences for totally chlorine-free (TCF) bleaching, but the pulp bleached in this way, when bleached to the brightness customary with ECF bleaching, exhibits poorer mechanical properties, evident from the significantly lower viscosity of the bleached pulp. The costs of these delignifying agents are also higher than for chlorine dioxide.

Another proposed alternative to chlorine dioxide has been a delignification with hydrogen peroxide in the acidic range in the presence of molybdate or tungstate as catalyst. U.S. Pat. No. 4,427,490 describes a delignification with hydrogen peroxide under acidic conditions in the presence of tungstate as catalyst. In Journal of Pulp and Paper Science Vol. 18 (1992), pages J108-J114, Kubelka describes a delignification with hydrogen peroxide, carried out at a pH of 5 using sodium molybdate as catalyst. U.S. Pat. No. 6,165,318 discloses heteropolytungstates and heteropolymolybdates as catalysts for delignification with hydrogen peroxide in the acidic range.

It has now been found that with bleaching sequences comprising two bleaching stages with hydrogen peroxide in the acidic range in the presence of a molybdate or tungstate and an intervening bleaching stage with hydrogen peroxide in the alkaline range, it is possible to produce a bleached pulp which by comparison with an ECF-bleached pulp exhibits no disadvantages in brightness and viscosity and has less of a tendency towards yellowing.

The invention accordingly provides a process for the delignification and bleaching of pulp, comprising a first bleaching stage with hydrogen peroxide in the presence of a molybdate or tungstate in an acidic aqueous mixture; subsequent to the first bleaching stage, a second bleaching stage with hydrogen peroxide in an alkaline aqueous mixture; and, subsequent to the second bleaching stage, a third bleaching stage with hydrogen peroxide in the presence of a molybdate or tungstate in an acidic aqueous mixture.

In the first bleaching stage of the process of the invention, the pulp is reacted with hydrogen peroxide in the presence of a molybdate or tungstate. Hydrogen peroxide is used preferably in an amount of 0.1 to 5 wt %, based on the mass of dry pulp employed. More preferably 0.2 to 2 wt % and most preferably 0.5 to 1 wt % of hydrogen peroxide are used. Hydrogen peroxide is used preferably in the form of an aqueous solution having a hydrogen peroxide content of 35 to 70 wt %.

In the first bleaching stage the reaction with hydrogen peroxide takes place in the presence of a molybdate or tungstate, which acts as catalyst for the hydrogen peroxide bleaching. The terms molybdate and tungstate in accordance with the invention encompass not only mononuclear molybdates and tungstates, such as $MoO_4^{2-}$ or $WO_4^{2-}$, but also polynuclear molybdates and tungstates, such as $Mo_7O_{24}^{6-}$, $Mo_8O_{26}^{4-}$, $HW_6O_{21}^{5-}$, $W_{12}O_{41}^{10-}$ or $W_{12}O_{39}^{6-}$, and polynuclear molybdates and tungstates containing heteroatoms, such as $PMo_{12}O_{40}^{3-}$, $SiMO_{12}O_{40}^{3-}$, $PW_{12}O_{40}^{3-}$ or $SiW_{12}O_{40}^{3-}$. When using molybdate as catalyst, the molybdate is employed preferably in an amount of 10 to 2000 ppm, more preferably 100 to 1500 ppm and most preferably 200 to 600 ppm of molybdenum, based on the mass of the dry pulp. When using tungstate as catalyst, the tungstate is used preferably in an amount of 200 to 10 000 ppm, preferably 500 to 1500 ppm and most preferably 1500 to 3000 ppm of tungsten, based on the mass of dry pulp. In accordance with the nomenclature rules referred to above, the first bleaching stage is designated Pmo if molybdate is used as catalyst, and Pw if tungstate is used as catalyst.

The molybdate or tungstate used as catalyst may be added before or after the hydrogen peroxide or at the same time as the hydrogen peroxide. In a preferred embodiment, the molybdate or tungstate and the hydrogen peroxide are added at the same time but separately from one another in the form of two aqueous solutions.

By choosing the amounts of hydrogen peroxide and molybdate in the preferred ranges, a particularly effective delignification and bleaching of the pulp is achieved, and a pulp is obtained that has a reduced yellowing tendency.

In the first bleaching stage of the process of the invention, the reaction of the pulp with hydrogen peroxide takes place preferably at a temperature of 50 to 150° C., more preferably of 60 to 120° C. and most preferably of 70 to 90° C. The reaction of the pulp with hydrogen peroxide takes place preferably for a time of 60 to 180 minutes, more preferably 90 to 120 minutes.

The reaction of the pulp in the first bleaching stage takes place in an acidic aqueous mixture. The reaction takes place preferably at a pH of the aqueous mixture in the range from 1 to 7, more preferably 2 to 5 and most preferably 2 to 4. This range for the pH refers to pH values measured at the end of the bleaching stage at the temperature of the reaction. The pH of the aqueous mixture is adjusted preferably by addition of an inorganic acid, more preferably by addition of sulphuric acid or hydrochloric acid.

In the first bleaching stage the reaction of the pulp takes place preferably at a pulp density in the range from 3% to 30%, i.e. in an aqueous mixture having a pulp content of 3 to 30 wt %, calculated as dry pulp relative to the total mass of the aqueous mixture. The pulp density is more preferably in the range from 5% to 20% and most preferably in the range from 8% to 15%.

In the second bleaching stage of the process of the invention, the pulp is reacted with hydrogen peroxide in an alkaline aqueous mixture. The reaction takes place preferably at a pH of the aqueous mixture in the range between 7 and 12, more preferably 8 to 11 and most preferably 9 to 11. This range for the pH refers to pH values measured at the end of the bleaching stage at the temperature of the reaction. The pH of the aqueous mixture is adjusted preferably by addition of an inorganic base, more preferably by addition of sodium hydroxide. Hydrogen peroxide is used preferably in an amount of 0.1 to 5 wt %, based on the mass of dry pulp employed. With particular preference 0.2 to 2 wt % and most preferably 0.5 to 1 wt % of hydrogen peroxide are used. The reaction of the pulp with hydrogen peroxide takes place preferably at a temperature of 50 to 100° C., more preferably of 60 to 100° C. and most preferably of 70 to 90° C. In accordance with the nomenclature rules referred to above, the second bleaching stage is designated Ep when its primary result is an extraction of alkali-soluble lignin degradation products formed in the first bleaching stage, and by P when its primary result is a bleaching of the pulp.

The second bleaching stage may take place with addition of oxygen. Oxygen in this case is used preferably in the form of substantially pure oxygen or in the form of oxygen-enriched air. When oxygen is added, the second bleaching stage is carried out preferably at a pressure of 0.1 to 1.5 MPa, more preferably at 0.3 to 1.0 MPa and most preferably of 0.3 to 0.5 MPa. When oxygen is added, the second bleaching stage, in accordance with the nomenclature rules referred to above, is designated Eop when its primary result is an extraction of alkali-soluble lignin degradation products formed in the first bleaching stage, by Po when its primary result is a bleaching of the pulp, and by Op when its primary result is a delignification of the pulp.

The second bleaching stage may be carried out with addition of a bleaching catalyst, preferably with addition of one of the manganese complexes known from WO 97/44520. With particular preference the binuclear manganese complex with the formula $(Me_2TACN)_2Mn^{III}Mn^{IV}(\mu\text{-}0)_2(\mu\text{-}OAc)]^{2+}2X^-$, where $Me_2TACN$ stands for 1,2-bis(4,7-dimethyl-1,4,7-triazacyclononan-1-yl)ethane, OAc stands for acetate and $X^-$ stands for a monovalent anion, known from WO 97/44520, is used as a bleaching catalyst. $X^-$ is then preferably acetate, chloride or hexafluorophosphate.

In the third bleaching stage of the process of the invention, the pulp is again reacted with hydrogen peroxide in the presence of a molybdate or tungstate in an acidic aqueous mixture. The preferred conditions for the reaction in the third bleaching stage correspond to the preferred conditions for the first bleaching stage. The third bleaching stage may be carried out under the same conditions as the first bleaching stage, or under differing conditions, for example with a smaller amount of hydrogen peroxide.

In a preferred embodiment of the process of the invention, a complexing agent is added in the first bleaching stage, in the third bleaching stage or in the first and third bleaching stages. For this purpose all of the complexing agents known from the prior art for reducing the decomposition of hydrogen peroxide in pulp bleaching can be used. Complexing agents used preferably are aminocarboxylic acids or aminophosphonic acids, more particularly ethylenediaminetetraacetic acid (EDTA), diethylenetriaminepentaacetic acid (DTPA), N-hydroxyethyl-N,N',N'-triacetic acid, cyclohexanediaminetetraacetic acid, aminotrimethylenephosphonic acid, ethylenediaminetetramethylenephosphonic acid, diethylenetriaminepentamethylenephosphonic acid, propylenediaminetetramethylenephosphonic acid, dipropylenetriaminepentamethylenephosphonic acid and 1-hydroxyethane-1,1-diphosphonic acid, and also their alkali metal salts. Other suitable complexing agents are ion exchangers based on bentonite, polyoxycarboxylate-polyacrylic acid copolymers, sodium iminosuccinate, aspartyl diethoxysuccinate, iminodisuccinate, ethylenediaminedisuccinate, methylglycinediacetic acid, nitrilotriacetic acid, modified anionic polyamine, and polyhydroxyacrylic acid. Particularly preferred complexing agents are EDTA and DTPA and their sodium salts. Complexing agents are used preferably in an amount of 0.05 to 1 wt %, based on the mass of dry pulp employed. The addition of a complexing agent allows better delignification and bleaching to be achieved for a given amount of hydrogen peroxide, or allows a reduction in the amount of hydrogen peroxide needed for achieving a desired degree of delignification and bleaching.

In the three bleaching stages of the process of the invention, further to the substances already identified, it is possible to employ further stabilizers, known from the prior art, for hydrogen peroxide bleaching, examples being waterglass and magnesium sulphate.

The pulp is preferably washed after the first bleaching stage and after the second bleaching stage. For this purpose the mixture resulting from the bleaching stage is preferably dewatered by filtration with a drum filter, a filter press or a screw press and is subsequently admixed with water to set the pulp density desired for the next bleaching stage. Alternatively or additionally it is possible to carry out a displacement wash with water on the filter. Washing the pulp keeps down the consumption of bleaching agent and auxiliaries for adjusting the pH in the second and third bleaching stages.

The process of the invention preferably comprises no further bleaching stages between the first and second bleaching stages and between the second and third bleaching stages. Corresponding preferred embodiments comprise the bleaching sequences PmoPPmo, PmoEpPmo, PmoPoPmo, PmoEopPmo, PmoOpPmo, PwPPw, PwEpPw, PwPoPw, PwEopPw and PwOpPw.

The process of the invention preferably comprises no further bleaching stages in which an oxidizing agent other than hydrogen peroxide and oxygen is used. The limitation to hydrogen peroxide and oxygen as oxidizing agents has the advantage that no toxic bleaching agents are required for the process, and that only storable bleaching agents are used.

In a preferred embodiment the process of the invention comprises, before the first bleaching stage, an additional stage of alkaline delignification of the pulp with oxygen, which is carried out preferably under pressure. The alkaline delignification with oxygen is preferably the first delignification stage in the process. Corresponding preferred embodiments comprise the bleaching sequences OPmoPPmo, OPmoEpPmo, OPmoPoPmo, OPmoEopPmo, OPmoOpPmo, OPwPPw, OPwEpPw, OPwPoPw, OPwEopPw and OPwOpPw. An upstream alkaline delignification with oxygen allows the oxygen consumption for the process of the invention to be reduced. Suitable conditions for alkaline delignification with oxygen are known to the skilled person from the prior art.

In another preferred embodiment, the process of the invention, after the third bleaching stage, comprises an additional bleaching stage with hydrogen peroxide in an alkaline aqueous mixture. The preferred conditions for the reaction in this additional bleaching stage correspond to the preferred conditions for the second bleaching stage.

The additional bleaching stage may be carried out under the same conditions as the second bleaching stage or under differing conditions, as for example with additional addition of oxygen. Corresponding preferred embodiments comprise the bleaching sequences PmoPPmoP, PmoEpPmoP, PmoPoPmoP, PmoEopPmoP, PmoOpPmoP, PwPPwP, PwEpPwP, PwPoPwP, PwEopPwP, PwOpPwP, PmoPPmoPo, PmoEpPmoPo, PmoPoPmoPo, PmoEopPmoPo, PmoOpPmoPo, PwPPwPo, PwEpPwPo, PwPoPwPo, PwEopPwPo and PwOpPwPo. The additional bleaching stage with hydrogen peroxide after the third bleaching stage is preferably combined with an alkaline delignification with oxygen that is carried out before the first bleaching stage. Corresponding preferred embodiments comprise the bleaching sequences OPmoPPmoP, OPmoEpPmoP, OPmoPoPmoP, OPmoEopPmoP, OPmoOpPmoP, OPwPPwP, OPwEpPwP, OPwPoPwP, OPwEopPwP, OPwOpPwP, OPmoPPmoPo, OPmoEpPmoPo, OPmoPoPmoPo, OPmoEopPmoPo, OPmoOpPmoPo, OPwPPwPo, OPwEpPwPo, OPwPoPwPo, OPwEopPwPo and OPwOpPwPo. Bleaching sequences of this embodiment are suitable in particular for the delignification and bleaching of softwood pulp.

In a likewise preferred embodiment, the process of the invention, before the first bleaching stage, comprises an additional stage of acidic hydrolysis with addition of at least one complexing agent. Complexing agents which can be used for this purpose are the compounds listed earlier on above for addition in the first or third bleaching stage. Complexing agents in this case are used preferably in an amount of 0.01 to 1 wt %, more preferably 0.1 to 0.5 wt %, based on the mass of dried pulp employed. The acidic hydrolysis is carried out preferably at a pH of the aqueous mixture in the range from 2 to 7, more preferably 3 to 6. This range for the pH refers to pH values measured at the end of the hydrolysis stage at the temperature of the reaction. The pH is adjusted preferably by addition of an inorganic acid, more preferably by addition of sulphuric acid or hydrochloric acid. The acidic hydrolysis is carried out preferably at a temperature of 50 to 100° C., more preferably at 60 to 90° C., preferably for a time of 60 to 480 minutes, more preferably 120 to 320 minutes, and preferably at a pulp density in the range from 2% to 30%, more preferably 5% to 15%. In accordance with the nomenclature rules referred to above, the acidic hydrolysis with addition of a complexing agent is designated Aq. Corresponding preferred embodiments comprise the bleaching sequences AqPmoPPmo, AqPmoEpPmo, AqPmoPoPmo, AqPmoEopPmo, AqPmoOpPmo, AqPwPPw, AqPwEpPw, AqPwPoPw, AqPwEopPw and AqPwOpPw. This embodiment may also be combined with the embodiment of a prior alkaline delignification of the pulp with oxygen, to give the bleaching sequences OAqPmoPPmo, OAqPmoEpPmo, OAqPmoPoPmo, OAqPmoEopPmo, OAqPmoOpPmo, OAqPwPPw, OAqPwEpPw, OAqPwPoPw, OAqPwEopPw and OAqPwOpPw. This embodiment may also be combined with the embodiment of a downstream additional alkaline bleaching stage with hydrogen peroxide, to give the bleaching sequences AqPmoPPmoP, AqPmoEpPmoP, AqPmoPoPmoP, AqPmoEopPmoP, AqPmoOpPmoP, AqPwPPwP, AqPwEpPwP, AqPwPoPwP, AqPwEopPwP, AqPwOpPwP, AqPmoPPmoPo, AqPmoEpPmoPo, AqPmoPoPmoPo, AqPmoEopPmoPo, AqPmoOpPmoPo, AqPwPPwPo, AqPwEpPwPo, AqPwPoPwPo, AqPwEopPwPo, AqPwOpPwPo, OAqPmoPPmoP, OAqPmoEpPmoP, OAqPmoPoPmoP, OAqPmoEopPmoP, OAqPmoOpPmoP, OAqPwPPwP, OAqPwEpPwP, OAqPwPoPwP, OAqPwEopPwP, OAqPwOpPwP, OAqPmoPPmoPo, OAqPmoEpPmoPo, OAqPmoPoPmoPo, OAqPmoEopPmoPo, OAqPmoOpPmoPo, OAqPwPPwPo, OAqPwEpPwPo, OAqPwPoPwPo, OAqPwEopPwPo and OAqPwOpPwPo. Furthermore, The stage of acidic hydrolysis with addition of a complexing agent may also be combined with a subsequent alkaline bleaching stage with hydrogen peroxide, to give the bleaching sequences AqPPmoPPmo, AqPPmoEpPmo, AqPPmoPoPmo, AqPPmoEopPmo, AqPPmoOpPmo, AqPPwPPw, AqPPwEpPw, AqPPwPoPw, AqPPwEopPw, AqPPwOpPw, OAqPPmoPPmo, OAqPPmoEpPmo, OAqPPmoPoPmo, OAqPPmoEopPmo, OAqPPmoOpPmo, OAqPPwPPw, OAqPPwEpPw, OAqPPwPoPw, OAqPPwEopPw, OAqPPwOpPw, AqPPmoPPmoP, AqPPmoEpPmoP, AqPPmoPoPmoP, AqPPmoEopPmoP, AqPPmoOpPmoP, AqPPwPPwP, AqPPwEpPwP, AqPPwPoPwP, AqPPwEopPwP, AqPPwOpPwP, AqPPmoPPmoPo, AqPPmoEpPmoPo, AqPPmoPoPmoPo, AqPPmoEopPmoPo, AqPPmoOpPmoPo, AqPPwPPwPo, AqPPwEpPwPo, AqPPwPoPwPo, AqPPwEopPwPo, AqPPwOpPwPo, OAqPPmoPPmoP, OAqPPmoEpPmoP, OAqPPmoPoPmoP, OAqPPmoEopPmoP, OAqPPmoOpPmoP, OAqPPwPPwP, OAqPPwEpPwP, OAqPPwPoPwP, OAqPPwEopPwP, OAqPPwOpPwP, OAqPPmoPPmoPo, OAqPPmoEpPmoPo, OAqPPmoPoPmoPo, OAqPPmoEopPmoPo, OAqPPmoOpPmoPo, OAqPPwPPwPo, OAqPPwEpPwPo, OAqPPwPoPwPo, OAqPPwEopPwPo and OAqPPwOpPwPo. The use of an additional stage of acidic hydrolysis with addition of at least one complexing agent before the first bleaching stage has particular advantages in the bleaching of hardwood pulp, and reduces the consumption of oxidizing agent in the subsequent bleaching stages.

The molybdate or tungstate used as catalyst in the first and third bleaching stages of the process of the invention is preferably recovered and returned to the bleaching stages. Methods particularly suitable for this purpose are those known from WO 2009/133053 and WO 2013/110419. In a preferred embodiment, therefore, the process of the invention comprises the additional steps of a) separating the pulp from the aqueous mixture subsequent to the first bleaching stage, the third bleaching stage or the first and third bleaching stages to give a molybdate- or tungstate-containing aqueous solution,
b) contacting the molybdate- or tungstate-containing aqueous solution obtained in step a) with a water-insoluble, cationized inorganic carrier material at a pH in the range between 2 and 7, to give a molybdate- or tungstate-laden carrier material and a molybdate- or tungstate-depleted aqueous solution,
c) separating the molybdate- or tungstate-laden carrier material from the molybdate- or tungstate-depleted aqueous solution,
d) contacting the molybdate- or tungstate-laden carrier material with an aqueous solution at a pH in the range between 7 and 14, to give a molybdate- or tungstate-depleted carrier material and a molybdate- or tungstate-laden aqueous solution, e) separating the molybdate- or tungstate-depleted carrier material from the molybdate- or tungstate-laden aqueous solution, and f) returning the molybdate- or tungstate-laden aqueous solution obtained in step d) to the first bleaching stage, the third bleaching stage or the first and third bleaching stages.

In step a) the delignified pulp is separated from the mixture obtained in the first bleaching stage, in the third bleaching stage or in the first and third bleaching stages, to give a molybdate- or tungstate-containing aqueous solution. The separation is accomplished preferably by filtration, more particularly by filtration with a drum filter, a filter press or a screw press. Suitable filtration techniques are known to the person skilled in the art of pulp bleaching.

In step b), the molybdate- or tungstate-containing aqueous solution obtained in step a) is contacted at a pH in the range between 2 and 7 with a water-insoluble, cationized inorganic carrier material. The pH is adjusted preferably to a level in the range from 3 to 5, more preferably in the range from 3.5 to 4. Adjustment to a pH within these ranges permits almost complete recovery of molybdate or tungstate from the aqueous solution with little consumption of pH-regulating agents. For the contacting, the water-insoluble, cationized inorganic carrier material is preferably dispersed with a stirrer or a disperser in the molybdate- or tungstate-containing aqueous solution. The contacting may take place at any desired temperature, suitable temperatures being in the range from 0 to 100° C. In step b) the cationized inorganic carrier material is used for contacting with the molybdate- or tungstate-containing aqueous solution, preferably in an amount of 10 to 1000 parts by weight of carrier material per part by weight of molybdenum or in an amount of 200 to 10 000 parts by weight of carrier material per part of weight of tungsten. For the recovery of molybdate, more preferably 50 to 500 and more particularly 100 to 300 parts by weight of carrier material are used per part of weight of molybdenum. For the recovery of tungstate, more preferably 1000 to 5000 and more particularly 2000 to 3000 parts by weight of carrier material are used per part by weight of tungsten.

Inorganic carrier materials, whose surface has been modified with positively charged functional groups, are suitable as cationized inorganic carrier material. The modification may take place, for example, by reaction of the surface with reagents which anchor a positively charged functional group covalently on the surface. Suitable water-insoluble, cationized inorganic carrier materials with covalently anchored, positively charged functional groups are, for example, precipitated or fumed silicas which have been modified with aminosilanes and preferably also quaternized on the amino group. The modification may also take place, alternatively, by ion exchange of an inorganic carrier material, negatively charged on the surface, with a quaternary ammonium salt. The quaternary ammonium salt used for this purpose preferably has at least one non-polar alkyl radical having 6 to 24, more preferably 12 to 22, carbon atoms, in order to prevent detachment of the quaternary ammonium ions from the carrier in the acidic range.

A cationized phyllosilicate is preferably used as water-insoluble, cationized inorganic carrier material, more preferably a phyllosilicate ion-exchanged with a quaternary ammonium salt. Suitable phyllosilicates here include kaolins, smectites, illites, bentonites (montmorillonites), hectorites, pyrophyllites, attapulgites, sepiolites and laponites, preferably bentonites, hectorites and attapulgites ion-exchanged with a quaternized ammonium salt, more preferably bentonite ion-exchanged with quaternary ammonium salt.

Bentonites, hectorites and attapulgites ion-exchanged with quaternized ammonium salts are available commercially: Quaternium-18 Bentonite as Bentone 34 from Rheox Corp. and as Claytone 34, Claytone 40 and Claytone XL from Southern Clay; Stearalkonium Bentonite as Tixogel LG from United Catalysts, as Bentone SD-2 from Elementis Specialties and as Claytone AF and Claytone APA from Southern Clay; Quaternium-18/Benzalkonium Bentonite as Claytone GR, Claytone HT and Claytone PS from Southern Clay; Quaternium-18 Hectorite as Bentone 38 from Rheox Corp.; Dihydrogenated Tallow Benzylmonium Hectorite as Bentone SD-3 from Rheox Corp.; Stearalkonium Hectorite as Bentone 27 from Rheox Corp.; and Cationized Attapulgite as Vistrol 1265 from Cimbar. These ion-exchanged phyllosilicates may be used both as powder and in the form of the commercially available dispersions in an oil or an organic solvent.

Besides the commercial bentonites, hectorites and attapulgites ion-exchanged with tetraalkylammonium ions, it is also possible to employ the corresponding materials ion-exchanged with quaternized alkanolamine fatty acid esters, more particularly bentonite ion-exchanged with dimethyldiethanolammonium mono- and difatty acid esters, and also methyltriethanolammonium mono-, di- and tri-fatty acid esters. Preference here is given to using corresponding esters with saturated fatty acids, especially saturated fatty acids having 12 to 18 carbon atoms.

In step c) the molybdate- or tungstate-laden carrier material is separated from the molybdate- or tungsten-depleted aqueous solution. The separation may take place with any of the solids/liquids separation methods known to the skilled person, as for example by sedimentation, filtration, centrifugation or flotation. The separated molybdate- or tungstate-depleted carrier material may additionally be washed with an aqueous solution having a pH of between 6 and 14, in order to complete the detachment of molybdate or tungstate from the carrier material. The wash liquor resulting from the washing is preferably combined with the molybdate- or tungstate-laden solution.

In step d), the molybdate- or tungstate-laden carrier material is contacted with an aqueous solution having a pH in the range between 7 and 14. This pH is selected preferably in the range from 8 to 12 and more preferably in the range from 9 to 11. The contacting may take place at any desired temperature, suitable temperatures being in the range from 0 to 100° C.

In step e) the molybdate- or tungstate-depleted carrier material is separated from the molybdate- or tungstate-laden aqueous solution. The separation may take place with any of the solids/liquids separation methods known to the skilled person, as for example by sedimentation, filtration, centrifugation or flotation. The separated molybdate- or tungstate-depleted carrier material may additionally be washed with an aqueous solution having a pH of between 6 and 14, in order to complete the detachment of molybdate or tungstate from the carrier material. The wash liquor resulting from the washing is preferably combined with the molybdate- or tungstate-laden solution. The molybdate- or tungstate-depleted carrier material removed in step e) is preferably used again in step b).

In a preferred embodiment the water-insoluble, cationized inorganic carrier material is arranged in a fixed bed. Steps b) and c) are then accomplished by passing the molybdate- or tungstate-containing aqueous solution through a fixed bed comprising the water-insoluble, cationized inorganic carrier material. As the molybdate- or tungstate-containing aqueous solution passes through the fixed bed, the molybdate or tungstate present in the solution already becomes bound to the water-insoluble, cationized inorganic carrier material, and the aqueous solution leaving the fixed bed is molybdate- or tungstate-depleted. After the loading of the water-insoluble cationized inorganic carrier material arranged in the fixed bed, steps d) and e) are carried out by passing an aqueous solution having a pH in the range between 6 and 14 through the fixed bed loaded with molybdate or tungstate in steps b) and c). The aqueous solution leaving the fixed bed here comprises the major fraction of the molybdate or tungstate bound in step b) to the water-insoluble, cationized inorganic carrier material, and, after these steps have been carried out, the fixed bed can be used again for the recovery of molybdate or tungstate in steps b) and c). The passing of the molybdate- or tungstate-containing aqueous solution through the fixed bed is preferably ended before the amount of molybdate or tungstate in the aqueous solution leaving the fixed bed rises above the desired residual level. The fixed bed preferably further comprises a water-insoluble packing material for increasing the porosity of the fixed bed in addition to the water-insoluble, cationized inorganic carrier material. Suitable water-insoluble packing materials are known from WO 2009/133053. The fixed bed comprises the water-insoluble, cationized inorganic carrier material and the water-insoluble packing material preferably in a weight ratio of from 10:1 to 1:100. With preference at least two fixed beds arranged in parallel are used, in which steps b) and c) and steps d) and e) are carried out in alternation—in other words, in a first fixed bed, molybdate or tungstate is recovered from an aqueous solution in steps b) and c), while in a second fixed bed, arranged in parallel and already laden with molybdate or tungstate, the molybdate or tungstate is detached again from the carrier in steps d) and e). In a particularly preferred embodiment, switching then takes place between the parallel fixed beds in such a way that the passage of the molybdate- or tungstate-containing aqueous solution through a fixed bed takes place continuously.

In step f) the molybdate- or tungstate-laden aqueous solution obtained in step d) is returned to the first bleaching stage, to the third bleaching stage or to the first and third bleaching stages.

Preferably, molybdate or tungstate is removed both from the aqueous mixture obtained in the first bleaching stage and from the aqueous mixture obtained in the third bleaching stage in two parallel steps a). In that case the recovery of molybdate or tungstate may be carried out in such a way that steps b) to f) are carried out each separately from one another with the molybdate- or tungstate-containing aqueous solutions obtained in the two steps a). With this embodiment, in the respective step f), the molybdate- or tungstate-laden aqueous solution is preferably returned to the bleaching stage from which the molybdate or tungstate was removed in the respective step a). Preferably, however, the molybdate- or tungstate-containing aqueous solutions obtained in two parallel steps a) are combined with one another, then steps b) to e) are carried out, and in step f) the molybdate- or tungstate-laden aqueous solution obtained in step e) is divided in accordance with the amount of catalyst desired in the respective bleaching stages, and is returned to the first and third bleaching stages.

The examples which follow illustrate the invention, but without restricting the subject matter of the invention.

EXAMPLES

All of the experiments were carried out with kraft pulps which had been delignified with oxygen under alkaline conditions. Examples 1 to 4 used an oxygen-delignified eucalyptus kraft pulp with a brightness of 64.7% ISO, Examples 5 and 6 an oxygen-delignified spruce kraft pulp with a brightness of 48.1% ISO.

The bleaching stages were each carried out under the experimental conditions indicated, with the pulp densities specified in Tables 1 to 6, the pulp being mixed with the corresponding amount of water and with the amounts of bleaching chemicals indicated in the tables, and maintained at the stated temperature in a plastics pouch within a thermostated waterbath. In a deviation from this procedure, in Examples 5 and 6, the alkaline, oxygen- and peroxide-assisted extraction Eop, the peroxide-assisted oxygen stage Op and the oxygen-assisted peroxide stage Po were carried out in a high-shear mixer at the oxygen pressure stated in each case. The amounts of bleaching chemicals stated are based on the mass of the dry pulp used in the bleaching sequence. In the case of EDTA, the amounts are based on the amount of the commercial 40 wt % aqueous solution used. For the catalysed bleaching with hydrogen peroxide in the presence of molybdate, the catalyst used was sodium molybdate in the form of an aqueous solution. The pH values at the start of a bleaching stage were determined at room temperature; the pH values at the end of the bleaching stage were determined at the temperature of the bleaching stage, in each case using a glass combination electrode.

Washing took place between each of the bleaching stages, by adding demineralised water to a pulp density of 2 wt %, intensive stirring of the resulting suspension and removal of the pulp from this suspension by means of vacuum filtration and centrifugation.

TABLE 1

Bleaching of oxygen-delignified eucalyptus kraft pulp in Example 1 with the bleaching sequence DEpDP

| Quantities used and bleaching parameters | Bleaching stage | | | |
|---|---|---|---|---|
| | D | Ep | D | P |
| $ClO_2$ in wt % of active chlorine | 2.6 | | 0.5 | |
| $H_2SO_4$ in wt % | 0.4 | | 0.1 | |
| $H_2O_2$ in wt % | | 0.4 | | 0.2 |
| NaOH in wt % | | 0.4 | | 0.4 |
| Temperature in ° C. | 90 | 85 | 80 | 80 |
| Time in minutes | 120 | 75 | 120 | 120 |
| Pulp density in % | 10 | 10 | 10 | 10 |
| pH at start | | 10.7 | | 11.2 |
| pH at end | 2.8 | 9.0 | 4.3 | 10.2 |

TABLE 2

Bleaching of oxygen-delignified eucalyptus kraft pulp in Example 2 with the bleaching sequence AqPPmoPPmoP

| Quantities employed and bleaching parameters | Bleaching stage | | | | | |
|---|---|---|---|---|---|---|
| | Aq | P | Pmo | P | Pmo | P |
| $H_2O_2$ in wt % | | 2.0 | 0.5 | 2.0 | 0.1 | 2.0 |
| $H_2SO_4$ in wt % | 0.25 | | 0.28 | | 0.28 | |
| NaOH in wt % | | 1.4 | | 1.4 | | 1.4 |
| Mo in wt % | | | 0.025 | | 0.01 | |
| EDTA in wt % | 0.2 | | 0.1 | | 0.1 | |
| Temperature in ° C. | 90 | 85 | 90 | 85 | 90 | 85 |
| Time in minutes | 300 | 90 | 120 | 90 | 60 | 90 |
| Pulp density in % | 10 | 10 | 10 | 10 | 10 | 10 |
| pH at start | 4.2 | 11.6 | 3.5 | 11.8 | 3.5 | 11.5 |
| pH at end | 4.0 | 10.7 | 4.0 | 10.5 | 4.1 | 10.7 |

TABLE 3

Bleaching of oxygen-delignified eucalyptus kraft pulp in Example 3 with the bleaching sequence DEpDP

| Quantities employed and bleaching parameters | Bleaching stage | | | |
|---|---|---|---|---|
| | D | Ep | D | P |
| $ClO_2$ in wt % of active chlorine | 1.86 | | 0.2 | |
| $H_2SO_4$ in wt % | 0.5 | | 0.15 | |
| $H_2O_2$ in wt % | | 0.2 | | 0.2 |
| NaOH in wt % | | 0.4 | | 0.4 |
| Temperature in ° C. | 90 | 85 | 80 | 80 |
| Time in minutes | 120 | 75 | 120 | 120 |
| Pulp density in % | 10 | 10 | 10 | 10 |
| pH at start | | 10.8 | | 11.4 |
| pH at end | 2.8 | 9.1 | 4.5 | 10.2 |

TABLE 4

Bleaching of oxygen-delignified eucalyptus kraft pulp in Example 4 with the bleaching sequence AqPPmoPPmoP

| Quantities employed and bleaching parameters | Bleaching stage | | | | | |
|---|---|---|---|---|---|---|
| | Aq | P | Pmo | P | Pmo | P |
| $H_2O_2$ in wt % | | 0.6 | 0.5 | 0.6 | 0.5 | 0.6 |
| $H_2SO_4$ in wt % | 0.25 | | 0.35 | | 0.35 | |
| NaOH in wt % | | 1.3 | | 1.3 | | 1.3 |
| Mo in wt % | | | 0.01 | | 0.01 | |
| EDTA in wt % | 0.2 | | 0.1 | | 0.1 | |
| Temperature in ° C. | 90 | 85 | 90 | 85 | 90 | 85 |
| Time in minutes | 300 | 240 | 120 | 240 | 120 | 240 |
| Pulp density in % | 10 | 10 | 10 | 10 | 10 | 10 |
| pH at start | 4.6 | 11.9 | 4.1 | 11.9 | 3.5 | 11.9 |
| pH at end | 4.7 | 10.7 | 4.3 | 10.7 | 3.9 | 10.7 |

TABLE 5

Bleaching of oxygen-delignified spruce kraft pulp in Example 5 of the bleaching sequence DEopD

| Quantities employed and bleaching parameters | Bleaching stage | | |
|---|---|---|---|
| | D | Eop | D |
| $ClO_2$ in wt % of active chlorine | 2.95 | | 1.0 |
| $H_2SO_4$ in wt % | 0.15 | | 0.03 |
| $H_2O_2$ in wt % | | 0.5 | |
| NaOH in wt % | | 1.0 | |
| $O_2$ in MPa | | 0.3 | |
| $MgSO_4$ in wt % | | 0.1 | |
| Temperature in ° C. | 90 | 80 | 75 |
| Time in minutes | 60 | 90 | 120 |
| Pulp density in % | 10 | 11 | 10 |
| pH at start | | | |
| pH at end | 2.8 | 10.8 | 3.9 |

TABLE 6

Bleaching of oxygen-delignified spruce kraft pulp in Example 6 with the bleaching sequence PmoOpPmoPo

| Quantities employed and bleaching parameters | Bleaching stage | | | |
|---|---|---|---|---|
| | Pmo | Op | Pmo | Po |
| $H_2O_2$ in wt % | 0.5 | 0.7 | 0.5 | 2.9 |
| $H_2SO_4$ in wt % | 0.25 | | 0.25 | |
| NaOH in wt % | | 1.0 | | 1.6 |
| $O_2$ in MPa | | 0.5 | | 0.5 |
| Mo in wt % | 0.02 | | 0.02 | |
| EDTA in wt % | 0.1 | | 0.1 | |
| $MgSO_4$ in wt % | | 0.1 | | 0.15 |
| Temperature in ° C. | 90 | 100 | 90 | 107 |
| Time in minutes | 120 | 75 | 120 | 160 |
| Pulp density in % | 10 | 11 | 10 | 12 |
| pH at start | 4.7 | — | 4.3 | — |
| pH at end | 5.2 | 10.4 | 5.1 | 10.8 |

For the bleached pulp, the brightness of the pulp was determined in accordance with the PAPTAC Standard E.1, and the viscosity of the pulp in accordance with TAPPI Standard T 236 om 99. In addition, the loss of brightness by heat ageing and the post-colour number (PC number) were determined using the TAPPI T 260 (wet) and TAPPI UM 200 (dry) methods. The results are summarized in Table 7.

In the pairs of experiments 1 and 2, 3 and 4, and 5 and 6, the conditions of the bleaching sequences were selected such that the pulp was bleached in each case to a comparable brightness. For eucalyptus kraft pulp, the bleaching sequence of the invention, by comparison with the industrial standard bleaching sequence with chlorine dioxide, achieves a lower level of fibre damage, evident from a higher viscosity. Furthermore, the pulps bleached with the process of the invention exhibited a better stability of brightness, i.e. a lower yellowing tendency, than the pulps bleached with chlorine dioxide.

TABLE 7

Properties of the pulps bleached in Examples 1 to 6

| Example | 1* | 2 | 3* | 4 | 5* | 6 |
|---|---|---|---|---|---|---|
| Bleaching sequence | $DE_pDP$ | $A_qP—P_{mo}PP_{mo}P$ | $DE_pDP$ | $A_qP—P_{mo}PP_{mo}P$ | $DE_{op}D$ | $P_{mo}O_pP_{mo}P_o$ |
| Brightness in % ISO | 91.8 | 91.4 | 90.1 | 89.5 | 87.3 | 87.2 |
| Viscosity in mPa*s | 14.4 | 16.0 | 15.0 | 17.2 | 15.2 | 12.7 |
| Heat ageing, wet: | | | | | | |
| Change in brightness in % ISO | −2.5 | −1.4 | −2.7 | −0.9 | −3.4 | −2.3 |
| PC number | 0.275 | 0.147 | 0.364 | 0.117 | 0.621 | 0.403 |
| Heat ageing, dry: | | | | | | |
| Change in brightness in % ISO | −1.9 | −2.0 | −1.9 | −1.4 | −2.8 | −2.3 |
| PC number number | 0.201 | 0.224 | 0.245 | 0.188 | 0.498 | 0.403 |

*not according to the invention

The invention claimed is:

1. A process for the delignification and bleaching of pulp, comprising:

a) a first bleaching stage in which pulp is reacted with hydrogen peroxide in the presence of a molybdate or tungstate in an acidic aqueous mixture;

b) subsequent to the first bleaching stage, a second bleaching stage in which pulp is reacted with hydrogen peroxide in an alkaline aqueous mixture; and c) subsequent to the second bleaching stage, a third bleaching stage in which pulp is reacted with hydrogen peroxide in the presence of a molybdate or tungstate in an acidic aqueous mixture;

wherein said process does not comprise a bleaching stage in which an oxidizing agent other than hydrogen peroxide and oxygen is used.

2. The process of claim 1, wherein in the first and third bleaching stages, the pulp is reacted with 0.1 to 5 wt % of hydrogen peroxide in the presence of 10 to 2000 ppm of molybdenum in the form of molybdate or 200 to 10 000 ppm of tungsten in the form of tungstate, based in each case on the mass of dry pulp, at a temperature of 50 to 150° C. and at a pH in the range from 1 to 7, and in the second bleaching stage the pulp is reacted with 0.1 to 5 wt % of hydrogen peroxide, based on the mass of dry pulp, at a temperature of 50 to 100° C. and at a pH in the range between 7 and 12.

3. The process of claim 1, wherein the pulp is washed after the first bleaching stage and after the second bleaching stage.

4. The process of claim 1, wherein said process does not comprise a further bleaching stage in which an oxidizing agent other than hydrogen peroxide and oxygen is used.

5. The process of claim 1, wherein the second bleaching stage is carried out with addition of oxygen at a pressure of 0.1 to 1.5 MPa.

6. The process of claim 1, wherein a complexing agent is added in the first bleaching stage, in the third bleaching stage or in the first and third bleaching stages.

7. The process of claim 1, comprising an additional stage of alkaline delignification of the pulp with oxygen before the first bleaching stage.

8. The process of claim 1, comprising an additional bleaching stage in which pulp is reacted with hydrogen peroxide in an alkaline aqueous mixture after the third bleaching stage.

9. The process of claim 1, comprising an additional stage of acidic hydrolysis with addition of a complexing agent before the first bleaching stage.

10. The process of claim 1, comprising the additional steps of:

a) separating the pulp from the aqueous mixture after the first bleaching stage, the third bleaching stage or the first and third bleaching stages to give a molybdate- or tungstate-containing aqueous solution;

b) contacting the molybdate- or tungstate-containing aqueous solution obtained in step a) with a water-insoluble, cationized inorganic carrier material at a pH in the range between 2 and 7, to give a molybdate- or tungstate-laden carrier material and a molybdate- or tungstate-depleted aqueous solution;

c) separating the molybdate- or tungstate-laden carrier material from the molybdate- or tungstate-depleted aqueous solution;

d) contacting the molybdate- or tungstate-laden carrier material with an aqueous solution at a pH in the range between 7 and 14, to give a molybdate- or tungstate-depleted carrier material and a molybdate- or tungstate-laden aqueous solution;

e) separating the molybdate- or tungstate-depleted carrier material from the molybdate- or tungstate-laden aqueous solution; and f) returning the molybdate- or tungstate-laden aqueous solution obtained in step d) to the first bleaching stage, the third bleaching stage or the first and third bleaching stages.

11. The process of claim 10, wherein the molybdate- or tungstate-depleted carrier material separated in step e) is used again in step b).

12. The process of claim 10, wherein in the first and third bleaching stages the pulp is reacted with 0.1 to 5 wt % of hydrogen peroxide in the presence of 10 to 2000 ppm of molybdenum in the form of molybdate or 200 to 10 000 ppm of tungsten in the form of tungstate, based in each case on the mass of dry pulp, at a temperature of 50 to 150° C. and at a pH in the range from 1 to 7, and in the second bleaching stage the pulp is reacted with 0.1 to 5 wt % of hydrogen peroxide, based on the mass of dry pulp, at a temperature of 50 to 100° C. and at a pH in the range between 7 and 12.

13. The process of claim 12, wherein a complexing agent is added in the first bleaching stage, in the third bleaching stage or in the first and third bleaching stages.

14. The process of claim 10, wherein said process does not comprise further bleaching stages between the first and second bleaching stages and between the second and third bleaching stages.

15. The process of claim 10, wherein the second bleaching stage is carried out with addition of oxygen at a pressure of 0.1 to 1.5 MPa.

16. The process of claim 10, wherein a complexing agent is added in the first bleaching stage, in the third bleaching stage or in the first and third bleaching stages.

17. The process of claim 10, comprising an additional stage of alkaline delignification of the pulp with oxygen before the first bleaching stage.

18. The process of claim 10, comprising an additional stage of acidic hydrolysis with addition of a complexing agent before the first bleaching stage.

* * * * *